US009839302B2

(12) United States Patent
Frost

(10) Patent No.: US 9,839,302 B2
(45) **Date of Patent: *Dec. 12, 2017**

(54) INFANT CARRIER

(71) Applicant: The ERGO Baby Carrier, Inc., Los Angeles, CA (US)

(72) Inventor: Karin Annette Frost, Makawao, HI (US)

(73) Assignee: The Ergo Baby Carrier, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/940,565

(22) Filed: Nov. 13, 2015

(65) Prior Publication Data

US 2016/0066704 A1 Mar. 10, 2016

Related U.S. Application Data

(63) Continuation of application No. 12/544,093, filed on Aug. 19, 2009, now Pat. No. 9,220,352.

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
USPC ..... 224/158–161
See application file for complete search history.

(56) References Cited

U.S. PATENT DOCUMENTS 2,973,889 A 3/1961 Phillips
3,327,914 A 6/1967 Abram
4,009,808 A 3/1977 Sharp
4,234,229 A 11/1980 Arnold
4,469,259 A 9/1984 Krich et al.
4,579,264 A 4/1986 Napolitano
4,651,366 A 3/1987 Lande et al.
4,724,988 A 2/1988 Tucker
4,901,898 A 2/1990 Colombo
4,986,458 A 1/1991 Linday
5,071,047 A 12/1991 Cordisco
5,129,406 A 7/1992 Magnusen et al.
(Continued)

FOREIGN PATENT DOCUMENTS

CA 2357614 3/2002
GB 2314026 12/1987
(Continued)

OTHER PUBLICATIONS

International Search Report and Written Opinion issued for PCT Application No. PCT/US2016/025261, dated Jun. 27, 2016, 8 pages.

(Continued)

*Primary Examiner* — Corey Skurdal
(74) *Attorney, Agent, or Firm* — Sprinkle IP Law Group

(57) ABSTRACT

Embodiments described herein provide infant carrying devices. In particular, embodiments described herein provide infant inserts to carry an infant in a child carrier. Inserts according to various embodiments can comprise a flexible panel having a curved shape that narrows toward one end of the panel. The panel can define a front opening to an area to hold the infant. A cushion can be disposed at the bottom of the area to hold the infant. The infant insert can be adapted to support an infant in a wearer facing position with the infant's knees raised. In particular, embodiments of infant inserts can be adapted to promote a spread-squat-position.

22 Claims, 7 Drawing Sheets

(56) References Cited

U.S. PATENT DOCUMENTS

| | | | |
|---|---|---|---|
| 5,178,309 | A | 1/1993 | Bicheler |
| 5,224,229 | A | 7/1993 | Smith |
| 5,224,637 | A | 7/1993 | Colombo |
| 5,371,909 | A | 12/1994 | McCarty |
| 5,425,381 | A | 6/1995 | Peterson et al. |
| 5,492,256 | A | 2/1996 | Ive |
| 5,813,580 | A | 9/1998 | Fair |
| 5,826,287 | A | 10/1998 | Tandrup |
| 5,988,742 | A | 11/1999 | Stevens |
| 6,055,686 | A | 5/2000 | Knight |
| D441,967 | S | 5/2001 | Reithmeier |
| 6,394,543 | B1 | 5/2002 | Dunne et al. |
| 6,409,060 | B2 | 6/2002 | Donine |
| 6,415,969 | B1 | 7/2002 | Higuchi |
| 6,467,840 | B1 | 10/2002 | Verbovszky et al. |
| 6,715,651 | B2 | 4/2004 | Le Gal |
| 6,772,925 | B2 | 8/2004 | O'Hare |
| 7,168,600 | B2 | 1/2007 | Hwang |
| 7,322,498 | B2 | 1/2008 | Frost |
| 7,494,031 | B2 | 2/2009 | Kassai et al. |
| 7,886,946 | B2 | 2/2011 | Gray |
| 8,028,871 | B2 | 10/2011 | Gray |
| 8,272,546 | B2 | 9/2012 | Leistensnider |
| 8,650,663 | B2 | 2/2014 | Fair et al. |
| 8,726,437 | B2 | 5/2014 | Hardesty |
| 8,745,794 | B1 | 6/2014 | McDermott |
| 9,220,352 | B2 | 12/2015 | Frost |
| 9,700,152 | B2 | 7/2017 | Telford et al. |
| 2003/0106916 | A1 | 6/2003 | Boone |
| 2004/0149790 | A1 | 8/2004 | Kassai et al. |
| 2004/0217633 | A1 | 11/2004 | Kassai et al. |
| 2005/0045674 | A1 | 3/2005 | Rehbein |
| 2005/0155995 | A1 | 7/2005 | Lee |
| 2005/0242136 | A1 | 11/2005 | Moriguchi et al. |
| 2006/0130220 | A1 | 6/2006 | Morgan et al. |
| 2007/0029356 | A1 | 2/2007 | Moriguchi et al. |
| 2007/0138845 | A1 | 6/2007 | Gold et al. |
| 2008/0047987 | A1 | 2/2008 | Price |
| 2008/0209639 | A1 | 9/2008 | Lord |
| 2010/0072236 | A1 | 3/2010 | Parness et al. |
| 2010/0147910 | A1 | 6/2010 | Schactner |
| 2016/0286980 | A1 | 10/2016 | Telford et al. |

FOREIGN PATENT DOCUMENTS

| | | | |
|---|---|---|---|
| JP | 09-099842 | A | 4/1997 |
| JP | 2005-131146 | A | 5/2005 |
| JP | 2005-185426 | | 7/2005 |
| JP | 2006-231033 | | 9/2006 |
| JP | 4170894 | B2 | 8/2008 |
| KR | 20-2010-0010658 | | 10/2010 |
| KR | 20-0462354 | | 9/2012 |
| WO | WO 95/05952 | A1 | 3/1995 |
| WO | WO 2012165840 | A2 | 12/2012 |

OTHER PUBLICATIONS

Casas, Rochelle, "Choosing a Carrier," The Continuum Concept Letter, Issue 9, New Native, Inc., Watsonville, CA 95076, 2 pgs.

"Spread-Squat-Position," published Nov. 9, 2007, downloaded from http://www.ergobabycarrier.com/press/2007/11/spreadsquatposition.htm . . . and printed on Jul. 16, 2009, Ergobaby, Inc., 3 pgs.

"Studies, Opinions and Scientific Papers" published Jan. 26, 2006, downloaded from http://www.ergobabycarrier.com/press/2006/01/studies-opinions-and-scie . . . , printed on Jul. 16, 2009, Ergobaby, Inc., 3 pgs.

International Search Report and Written Opinion for PCT Application No. PCT/US2010/045886, dated Sep. 27, 2010, dated Oct. 6, 2010, 8 pgs.

International Preliminary Report on Patentability for PCT Patent Application No. PCT/US2010/045886, dated Mar. 1, 2012, 7 pgs.

Office Action for U.S. Appl. No. 12/544,093, dated Mar. 20, 2012, 15 pgs.

Office Action for U.S. Appl. No. 12/544,093, dated Dec. 3, 2012, 12 pgs.

Extended European Search Report for European Patent Application No. 10 810 544.6, dated Apr. 23, 2013, 9 pgs.

Chinese Office Action for Chinese Patent Application No. 201080046673.0, dated Oct. 25, 2013, 16 pages.

Office Action for U.S. Appl. No. 12/544,093, dated Mar. 26, 2014, 19 pgs.

Communication Under Rule 71(3) EPC (Notice of Allowance) for European Patent Application No. 10 810 544.6, dated May 15, 2014, 27 pgs.

Office Action for Chinese Patent Application No. 201080046673.0, dated Aug. 14, 2014, 6 pgs.

Office Action for Chinese Patent Application No. 201080046673.0 dated Feb. 13, 2015, 3 pgs.

Office Action issued for U.S. Appl. No. 15/087,628, dated Sep. 27, 2016, 12 pages.

International Preliminary Report on Patentability for PCT Patent Application No. PCT/US2016/025261, dated Oct. 12, 2017, 6 pgs.

INFANT CARRIER

CROSS-REFERENCE TO RELATED APPLICATION

This application is a continuation of, and claims a benefit of priority under 35 U.S.C. 120 of the filing date of U.S. patent application Ser. No. 12/544,093, filed Aug. 19, 2009, by inventor Karin Annette Frost entitled "Infant Carrier", the entire contents of which are hereby expressly incorporated by reference for all purposes.

TECHNICAL FIELD

The present disclosure relates to child carriers. More particularly, the present disclosure relates to systems for carrying infants. Even more particularly, the present disclosure relates inserts for transporting infants in a child carrier designed to carry larger children.

Wearable child carriers allow parents to carry children comfortably while maintaining freedom of hand and arm movement. Available carriers carry children in a variety of positions. Depending on the configuration of the child carrier, a parent can position the child in front of the parent, behind the parent or at the side of the parent. Some child carriers can carry children in any of these positions. For example, the ERGObaby baby carrier, allows parents to configure the carrier as a front carrier, a back pack or hip carry position (ERGObaby is a trademark of Ergobaby, Inc. of Pukalani, Hi.).

In general, it is recommended that young children be carried in slings or front carriers. Slings can be uncomfortable for parents as the weight of the child is unevenly distributed across the parent's shoulders. Front carriers hold a child in an upright position with the child's legs hanging down and the base of the child's spine supporting the child's bodyweight. This position may not be optimal for infants. While an adult spine has four curves, a young child's spine only has two curves. A majority of the child's spine will form a C-shape (so-called total kyphosis). Positioning an infant in an upright position may unduly and limit curvature of the spine and puts stress on the infant's sacrum. This can cause the infant's pelvis to tilt backward limiting leg and hip movement, which may impede healthy development of the infant's pelvis.

The current solution to this problem is to either wear the infant in a sling or, for front carriers, to wrap the infant in a blanket or padded sheet and lay the infant at an angle in the child carrier across the parent's torso. The infant will be in a reclined position with both of its feet sticking out of a single leg hole of the child carrier. However, it can be difficult and frustrating to properly position the infant in the child carrier in this manner and some parents find this configuration uncomfortable.

SUMMARY

Embodiments described herein provide infant carriers. One embodiment can include an infant insert to carry an infant. The infant insert can include a flexible panel having an inner surface and an outer surface. The panel can have a curved shape that narrows toward the bottom of the panel and can define a front opening to an area for holding an infant. The elongated panel can be sized to provide support along the infant's spine and neck. The infant insert can further comprise a cushion adapted to support the infant forward of the infant's tailbone when in use. The infant insert is sized and configured for placement in a child carrying area of a front wearable child carrier to accommodate an infant in a wearer facing position with the infant's knees raised. In one embodiment, the infant insert can be adapted to support the infant in a position with the infant's femur at an angle of 90-120 degrees from the coronal plane. Additionally, the infant insert can be adapted to support the infant in a position with the infant's knees at 45-60 degrees from the median plane. In particular embodiments, the infant insert can be adapted to promote a spread-squat-position.

Another embodiment of an infant insert can comprise an elongated flexible panel having an inner surface, an outer surface, a first side edge, a second side edge, a top edge, a bottom edge, a first bottom corner and a second bottom corner. The first bottom corner and second bottom corner can be stitched together to form a cushion opening at the bottom of the panel and cause the first side edge and second side edge to converge to form a tapered front opening to an area to hold an infant. The length of the panel from the top edge to the bottom edge can be selected to allow the panel to provide support along the infant's spine and neck and provide a head rest area. The width of the elongated panel can be selected so that the panel provides side padding for the infant when in use. The elongated flexible panel can further include a continuous rail of padding at the first side edge, top edge, and the second side edge and an area of spinal padding disposed about a vertical axis of the panel to provide padding for the infant's spine. The infant insert can further include a cushion disposed in the cushion opening at the bottom of the area to hold the infant. The infant insert can be adapted to fit in a child carrying area of a front wearable child carrier to position the infant in a wearer facing position.

One embodiment of a method can include placing an infant insert in a child carrying area of a child carrier in a front carrying position on a wearer. The infant insert can be positioned so that the infant is facing the wearer of the child carrier and the infant's spine and neck are supported by the panel. The method can further comprise tilting the infant's pelvis forward to eliminate weight directly on the sacrum. The infant is positioned so that the infant's knees are raised at least 90 degrees from the coronal plane.

The infant insert can comprise a flexible panel having an inner surface and an outer surface. The panel can have a curved shape that narrows toward the bottom of the panel and can define a front opening to an area for holding an infant. The panel is sized to provide support along the infant's spine and neck. The infant insert can further comprise a cushion disposed proximate to the bottom of the area for supporting an infant. The cushion can be adapted to support the infant forward of the infant's tailbone when in use.

Embodiments of infant inserts described herein provide several advantages. Compared to previous inserts in which the infant reclined in a sling like position, embodiments described herein allow an infant to be positioned front-to-front with its parent. This can be a more convenient position for the parent and foster closeness. The infant is in a slightly reclined position with the insert supporting infant's spine and legs. The infant's weight is distributed across the infant's bottom, thighs and back so that the sacrum does not bear too much weight and the infant can rest with a more naturally curved spine in a spread-squat-position that is believed to be better for pelvic development.

BRIEF DESCRIPTION OF THE DRAWINGS

A more complete understanding of the embodiments and the advantages thereof may be acquired by referring to the following description, taken in conjunction with the accompanying drawings in which like reference numbers indicate like features and wherein.

DETAILED DESCRIPTION

The disclosure and various features and advantageous details thereof are explained more fully with reference to the exemplary, and therefore non-limiting, embodiments illustrated in the accompanying drawings and detailed in the following description. Descriptions of known starting materials and processes may be omitted so as not to unnecessarily obscure the disclosure in detail. It should be understood, however, that the detailed description and the specific examples, while indicating the preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited to only those elements but may include other elements not expressly listed or inherent to such process, product, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead these examples or illustrations are to be regarded as being described with respect to one particular embodiment and as illustrative only. Those of ordinary skill in the art will appreciate that any term or terms with which these examples or illustrations are utilized encompass other embodiments as well as implementations and adaptations thereof which may or may not be given therewith or elsewhere in the specification and all such embodiments are intended to be included within the scope of that term or terms. Language designating such non-limiting examples and illustrations includes, but is not limited to: "for example," "for instance," "e.g.," "in one embodiment," and the like.

Reference is now made in detail to the exemplary embodiments of the disclosure, examples of which are illustrated in the accompanying drawings. Wherever possible, like numerals will be used throughout the drawings to refer to like and corresponding parts (elements) of the various drawings.

Figure 1:
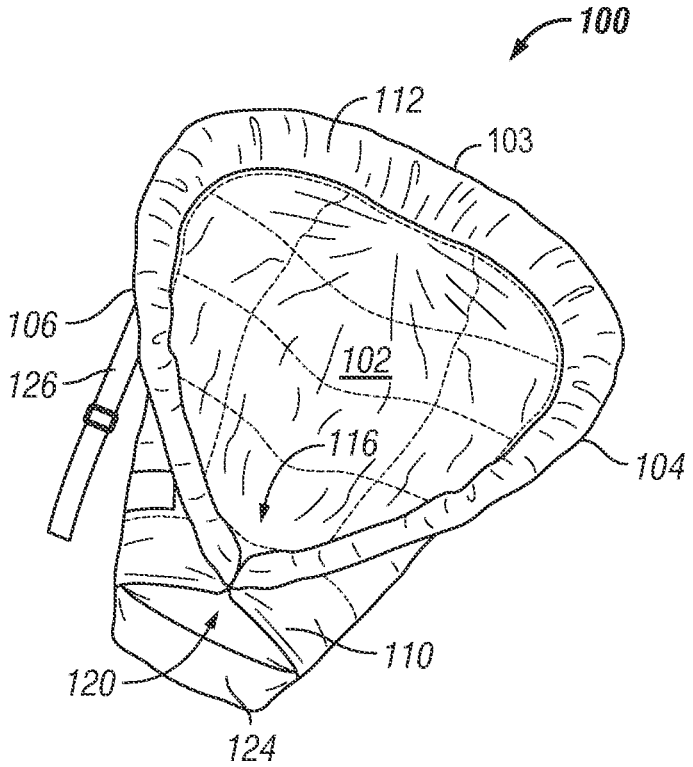
FIG. 1 is a diagrammatic representation of one embodiment of an infant insert.

Embodiments described herein provide devices and methods for carrying infants. Particular embodiments provide an infant insert that fits in a child carrier to hold an infant in a wearer facing position (i.e., front-to-front position relative to the wearer of the child carrier) without placing undue stress on the infant's sacrum and allowing the infant to hold its legs in a more natural position. FIG. 1 is a diagrammatic representation of one embodiment of an infant insert 100 to support an infant in a child carrier. Insert 100 can include a panel 102 of flexible material having an inner (facing the infant) and outer side. Panel 102 can be sized and shaped to fit in the area of a child carrier where a child typically sits. According to one embodiment, panel 102 can have an elongated shape such as a rectangle, oval or other elongated shape. In other embodiments, panel 102 can be round or square. Panel 102 can have a length that is sufficient to provide support along the spine of the infant when in use. Panel 102 can have a length that is sufficient so that panel 102 can provide support along an infant's spine and neck. Additionally, panel 102 can be long enough to provide a head rest area; that is, an area against which the infant can rest its head (indicated at 103). Additionally, in one embodiment the width of panel 102 can be sufficient so that the panel provides padding at the side of the infant when in use. The size of panel 102 can be further selected so that infant insert 100 does not unduly move when used in the carrier.

In the embodiment shown, panel 102 has a generally rectangular shape with an outer edge having a first side edge 104, a second side edge 106, a top edge 108 and a bottom edge 110 with rounded corners between the top edge and side edges and square corners 105/107 (see FIG. 3) between the side edges and the bottom edge. The shape of FIG. 1 is provided by way of example and panel 102 can have any suitable shape. Panel 102 can be a single panel or may include multiple panels of the same or varying material coupled together to form panel 102.

Panel 102 can be made of any suitable material(s). In one embodiment, panel 102 is a padded panel having an outer shell of a flexible breathable material, such as cotton, that is comfortable for an infant. Other fabrics can also be used including, but not limited to, synthetic fabrics, fleece, or other materials. The shell can contain padding for the comfort of the infant.

According to one embodiment, a rail 112 extends around the side and top edge of panel 102. Rail 112 is an area of increased padding positioned to fit under the infant's legs when in use. While shown at the edge of panel 102, rail 112 may be inset from edge of panel 102. Moreover, while rail 112 extends along the sides of panel 102 and around the top of panel 102 in the embodiment shown, rail 112, in other embodiments, can also extend along the bottom edge of panel 102. In yet other embodiments, padding to support an infant's legs may be disposed in separate areas or rails rather than a continuous rail.

According to one embodiment, panel 102 can have a curved shape that narrows toward the bottom end. As an example, panel 102 can be rolled or folded so that the side edges 104 and 106 of panel 102 converge near the bottom of the panel. Consequently, the edges are more proximate to each other closer to the bottom of panel 102 and more distal from each other closer to the top of panel 102. The side edges 104 can thus form a V-shaped or tapered front opening to an area for holding the infant. Edges 104 and 106 can be brought together at a point below which an infant's legs extend out of the front opening if the infant is large enough. This can help ensure that rail 112 passes under the infant's thighs for infants who are large enough to sit with their legs at the parent's sides (see FIG. 9). In the embodiment of FIG. 1, edges 104 and 106 converge completely to form opening 120 proximate to the bottom of panel 102.

According to one embodiment, the bottom corners 105 and 107 (see FIG. 3) of panel 102 are coupled together so that edge 104 and edge 106 overlap. The bottom corners can be securely stitched together, buttoned together, fastened together with hook and eye fasteners or otherwise coupled together. In other embodiments, however, edges 104 and 106 may not converge all the way but may only converge sufficiently to bring rail 112 under an infant's thighs. In other embodiments, side edges 104 and 106 can be drawn together to form a tapered front opening using a strap or fastener with or without coming in contact with each other.

Insert 100 can include a cushion 122 (illustrated in FIG. 4) that can be disposed in opening 120 at the bottom of the infant holding area. Cushion 122 can be maintained in opening 120 based on the geometry of cushion 122. In other embodiments, a cushion retaining strap 124, pouch or other retaining member can help retain cushion 122. Cushion 122 can be integral with or attached to panel 102. In other embodiments, cushion 122 can be removable for easy cleaning. Cushion 122 can include a shell material that is the same as or different than the material used for panel 102.

Figure 2:
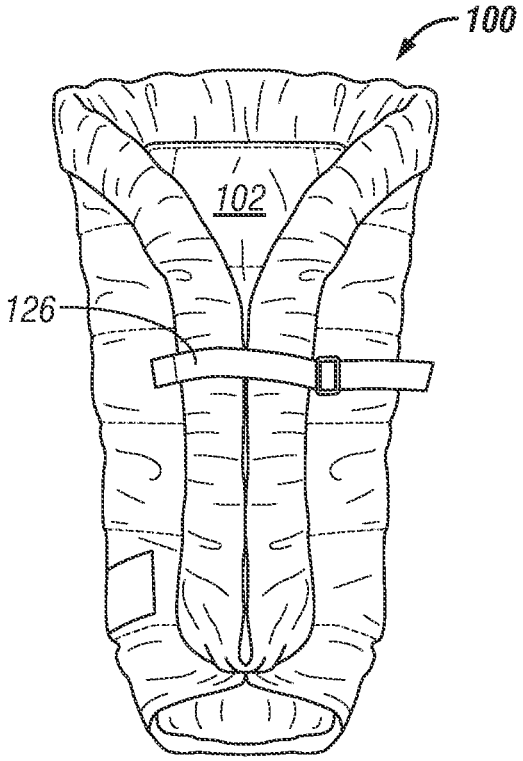
FIG. 2 is a diagrammatic representation of an embodiment of an infant insert with a closure strap tightened.

According to one embodiment, infant insert 100 can include a closing strap 126 that can be used to close or decrease the size of the front opening so that panel 102 more closely swaddles the infant. FIG. 2 is a diagrammatic representation of an embodiment of infant insert 100 with strap 126 tightened. In FIG. 2, panel 102 is formed into a more tube-like shape that will more closely swaddle a small infant. According to one embodiment, one end of strap 126 is sewn to the outer side on one half of panel 102 (e.g., the left or right half) while the free end buttons or is otherwise detachably coupled to the other half of the outer side. In another embodiment, strap 126 can be fully removable. Strap 126 can be adjustable so that the size of the front opening can be selected.

Figure 3:
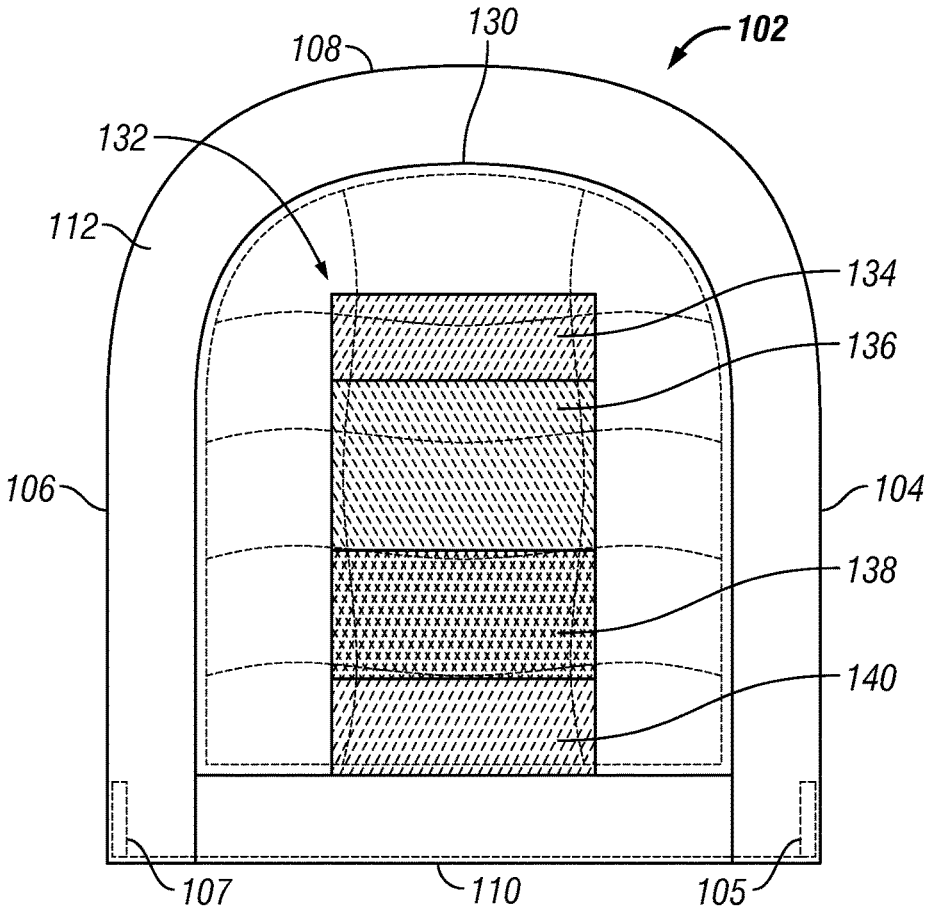
FIG. 3 is a diagrammatic representation of one embodiment of a panel.

FIG. 3 is a diagrammatic representation of one embodiment of panel 102 showing side edge 104, side edge 106, top edge 108, bottom edge 110 and continuous rail 112. In the embodiment of FIG. 3, corners 105 and 107 are separated to illustrate the inner surface of panel 102. The inner surface of panel 102 is configured to support an infant. Panel 102 can include a back pad area 130 to provide padding for an infant. Padded area 130 can have any desired shape or size. Padding in padded area 130 can be uniform throughout padded area 130 or may vary.

Panel 102, in one embodiment, can include a spinal pad area 132 that is positioned to provide padding for an infant's spine. Spinal pad area 132 can be located about the vertical axis of panel 102. Spinal pad area 132 can include any number of sections having different amounts of padding. In the example shown, spinal pad area 132 has at least three sections 134, 136 and 138. According to one embodiment, the padding progressively increases from section 134 to section 138. Section 138 can be more padded because it is expected that the infant's lower back will more likely rest against section 138. An additional section of padding 140 may be included below section 138. However, section 140 can include little or no padding as it may be covered by cushion 122 (illustrated in FIG. 4). In one embodiment, progressively increased padding can be achieved by stacking layers of padding. The more layers in a given section, the more padded that section will be. Additional areas of panel 102 can be padded, such as rails 112. The shell of panel 102 can be sewn in a quilted pattern to retain the padding within the shell.

Figure 4:
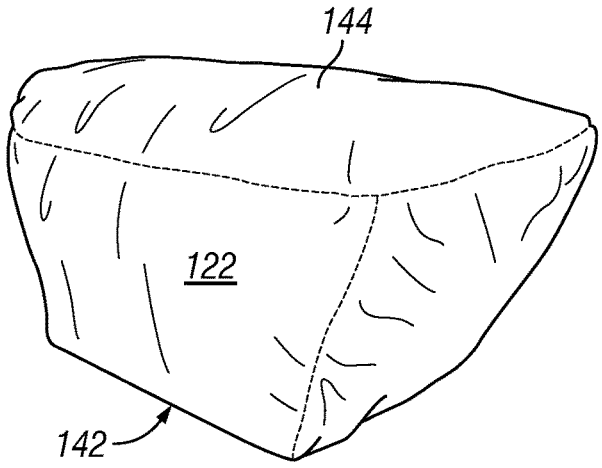
FIG. 4 is a diagrammatic representation of one embodiment of a cushion.

FIG. 4 is a diagrammatic representation of one embodiment of cushion 122. In the embodiment shown, cushion 122 can have a tapered shape so that the bottom 142 of cushion 122 will fit through opening 120, but the top 144 of cushion 122 will not unless forced. However, as shown in FIG. 1, a retaining strap 124 can help retain cushion 122. Cushion 122 can be padded to have a desired softness and support. According to one embodiment, the size of cushion 122 can be selected so that cushion 122 will reach the hollow of the infant's knees when the infant is positioned with its legs spread around the wearer's body. When an infant is too large for the infant insert, cushion 122 can be placed in a child carrier to help boost the child. While illustrated as a removable cushion, cushion 122 can be fixed to infant carrier 100.

Figure 5:
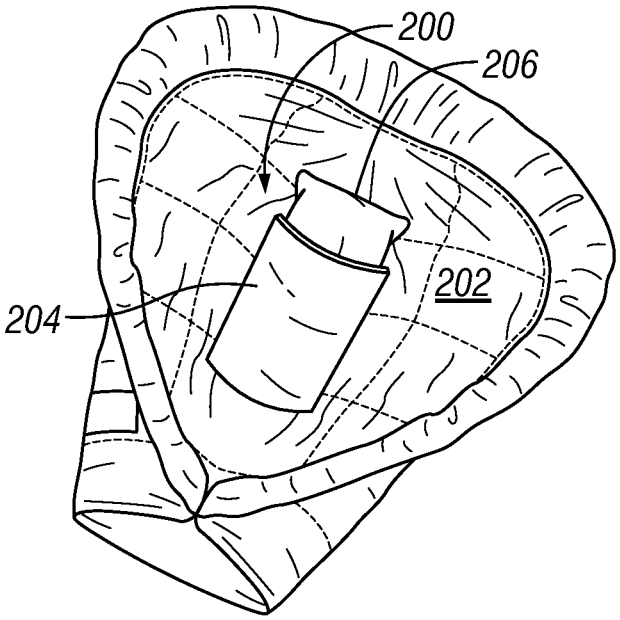
FIG. 5 is a diagrammatic representation of another embodiment of an infant insert.

FIG. 5 is a diagrammatic representation of another embodiment of an infant insert 200. Insert 200 can have a panel 202 that is similar to panel 102 of FIG. 1. Panel 202 can include a pouch 204 for a removable back cushion 206 that provides spinal padding. Cushion 206 can have uniform padding or padding that varies along the length of cushion 206. Cushion 206 can be positioned to provide padding along the infant's spine. In the embodiment of FIG. 5, infant insert 200 does not include cushion retaining strap 124 or closing strap 126.

In operation, infant insert 100 or 200 can be used in conjunction with a child carrier. Child carriers typically include a harness and one or more panels for holding a child. The harness provides shoulder straps, waistbands, chest straps or other harnessing so that an adult can wear the child carrier. The carrier panel(s) forms flexible or rigid confines of a child carrying area.

Using an example of a carrier with a flexible fabric panel, the lower portion of the panel attaches at its center to the harness (typically near a waistband) and the upper corners (or other portions) of the panel attach to the harness near the adult's shoulders or chest. The carrier panel and parent's torso cooperate to hold the baby in the correct position. Typically, child carriers are designed so that the legs of the child can dangle out of leg holes. Some child carriers include material between the child and the parent while other child carriers leave the space between the child and parent open. There are a large number of child carriers on the market that may include more components such as hoods, support legs and other options. One of ordinary skill in the art would understand that inserts described herein can be adapted for use with a variety of child carriers known or developed in the art.

Figure 6:
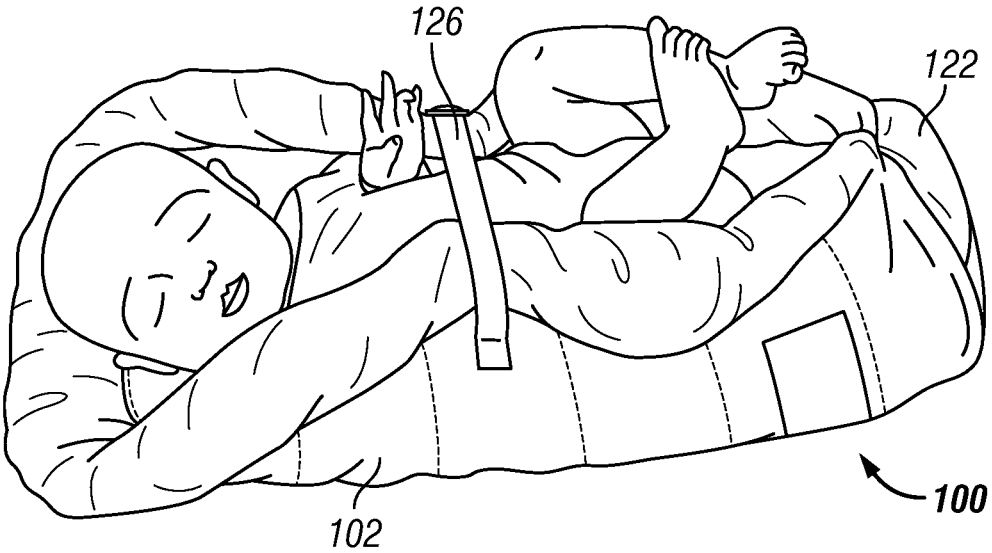
FIG. 6 illustrates an embodiment of an infant positioned in an embodiment of an infant insert.

FIG. 6 illustrates an embodiment of an infant positioned in an infant insert 100. The infant can lie in the center of infant insert 100 with its bottom situated next to cushion 122. If desired, closure strap 126 can be used so that panel 102 curves around the infant to provide padding at the side of the infant and more closely swaddling the infant. The infant's legs can be naturally open with its knees in a comfortable bend. Panel 102 can provide support along the infant's spine and neck and the infant's head can rest on a portion of panel 102. When infant insert 100 is placed in a child carrier, infant insert 100 can provide padding at the back, neck and sides of the infant.

Figure 7:
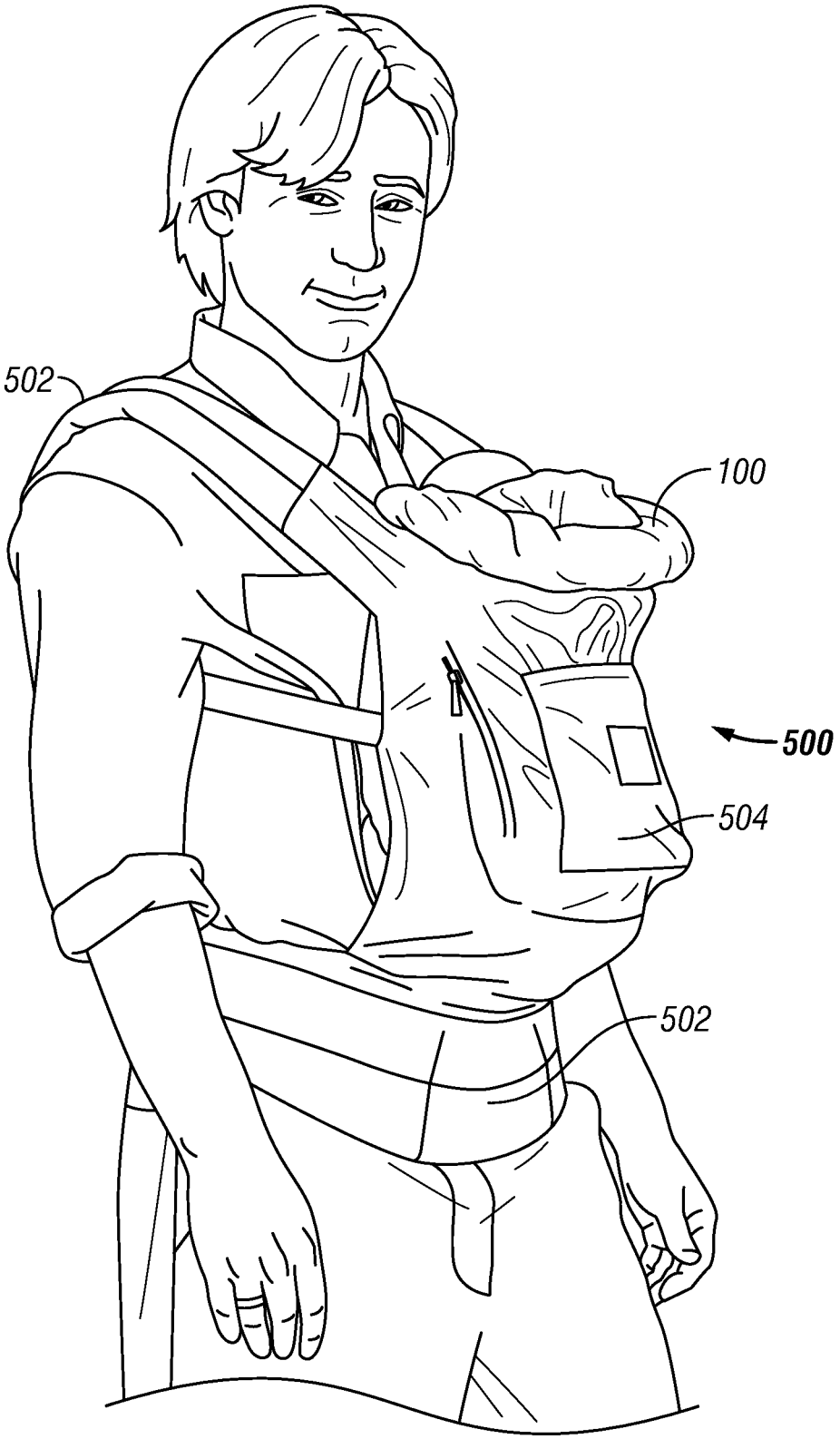
FIG. 7 is a diagrammatic representation of an adult wearing an embodiment of a child carrier in a front position with and embodiment of an infant insert in place.

FIG. 7 is a diagrammatic representation of an adult wearing a child carrier in a front position with infant insert 100 in place. The infant is in a wearer facing position. Child carrier 500 includes harnessing 502, such as a waist band and shoulder straps, and a panel 504. Panel 504 in cooperation with the parent's torso form a carrying area in which a child would typically sit. Example child carriers are described in U.S. Pat. No. 7,322,498, issued Jan. 29, 2008 to Frost, which is hereby fully incorporated by reference herein. Example available child carriers include, but are not limited to the ERGOBaby baby carriers and other child carriers.

Infant insert 100 can be disposed in the area of child carrier 500 that holds a child. According to one embodiment the vertical axis of insert 100 can be substantially aligned with that of carrier 500. Infant insert 100 can be long enough, so that a portion of infant insert 100 can extend beyond the child carrying area of the child carrier.

Figure 8:
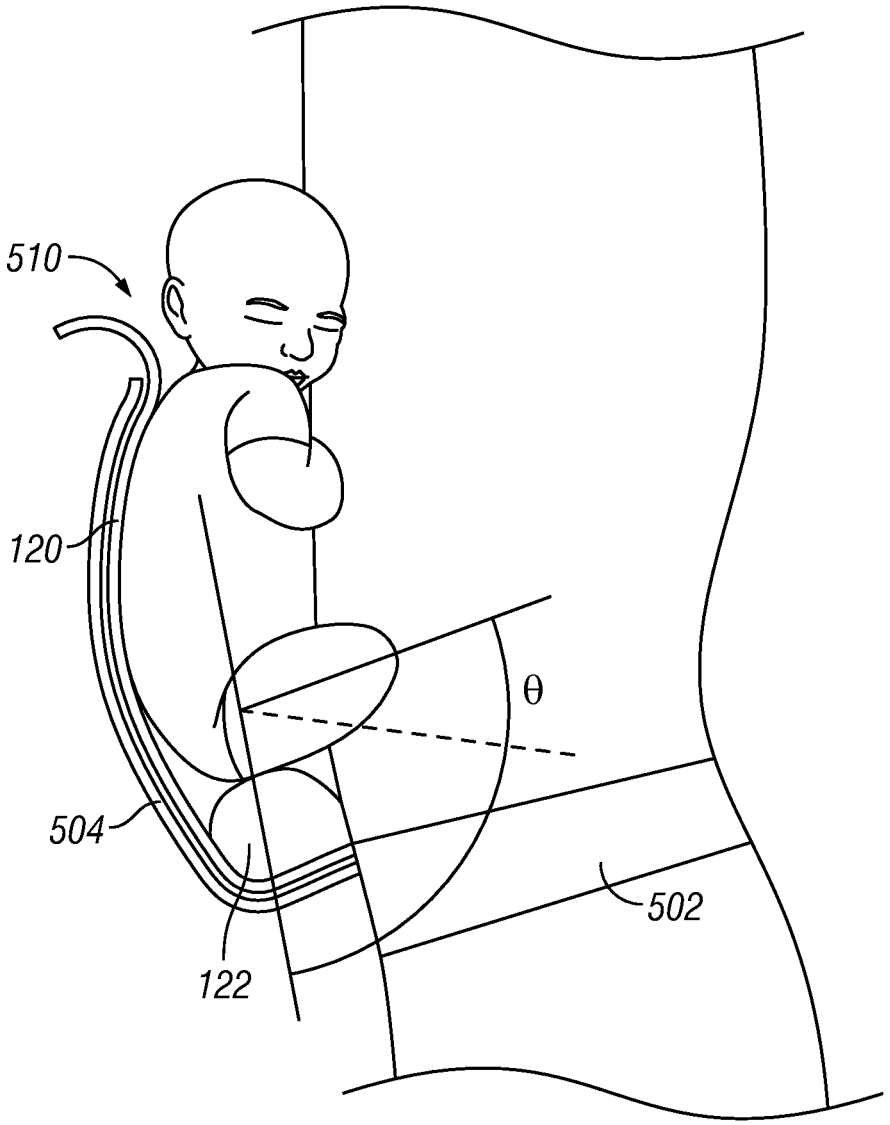
FIG. 8 is a diagrammatic representation illustrating an infant in position in an embodiment of an infant insert when used in conjunction with a child carrier.

FIG. 8 is a diagrammatic representation illustrating an infant in position in infant insert 100 when used in conjunction with carrier 500. FIG. 8 illustrates a flexible panel 504 and a portion of harnessing 502. Panel 504 forms a pouch in which a child sits (denoted by area 510). Infant insert is positioned in this area. The infant reclines back onto panel 102. Additionally, the infant can be positioned on the cushion 122 so that the infant is not sitting with a majority of its weight on the tailbone. Instead, the infant can be positioned so that cushion 122 contacts and supports the infant's thighs and/or bottom forward of the tailbone. Cushion 122 will compress to distribute weight along the infant's thighs. Additionally the infant's spine can be naturally bent. A parent can aid in achieving this position by reaching under the baby's bottom and tilting its pelvis forward, thereby positioning the infant with a naturally curved spine.

In one embodiment, the infant insert allows the infant to be positioned so that the infant's femur can be at least 90 degrees from the coronal plane of the infant (the plane dividing anterior and posterior sections of the body). In other embodiments the angle can be approximately 110 or 120 degrees. Greater or lesser angles may be achieved based on the range of motion of the infant. Additionally, the infant can be positioned so that its knees are spread apart. According to one embodiment, the infant can be positioned with each knee at least 20 degrees from the median plane (the plane that dividing left and right sections of the body). In some embodiments the infant can be positioned with its knees approximately 45-60 degrees or more (depending on the range of motion of the infant) from the median plane. It should be noted, however, that the infant can be positioned in any comfortable position, emphasizing a support posture rather than a sitting posture.

Figure 9:
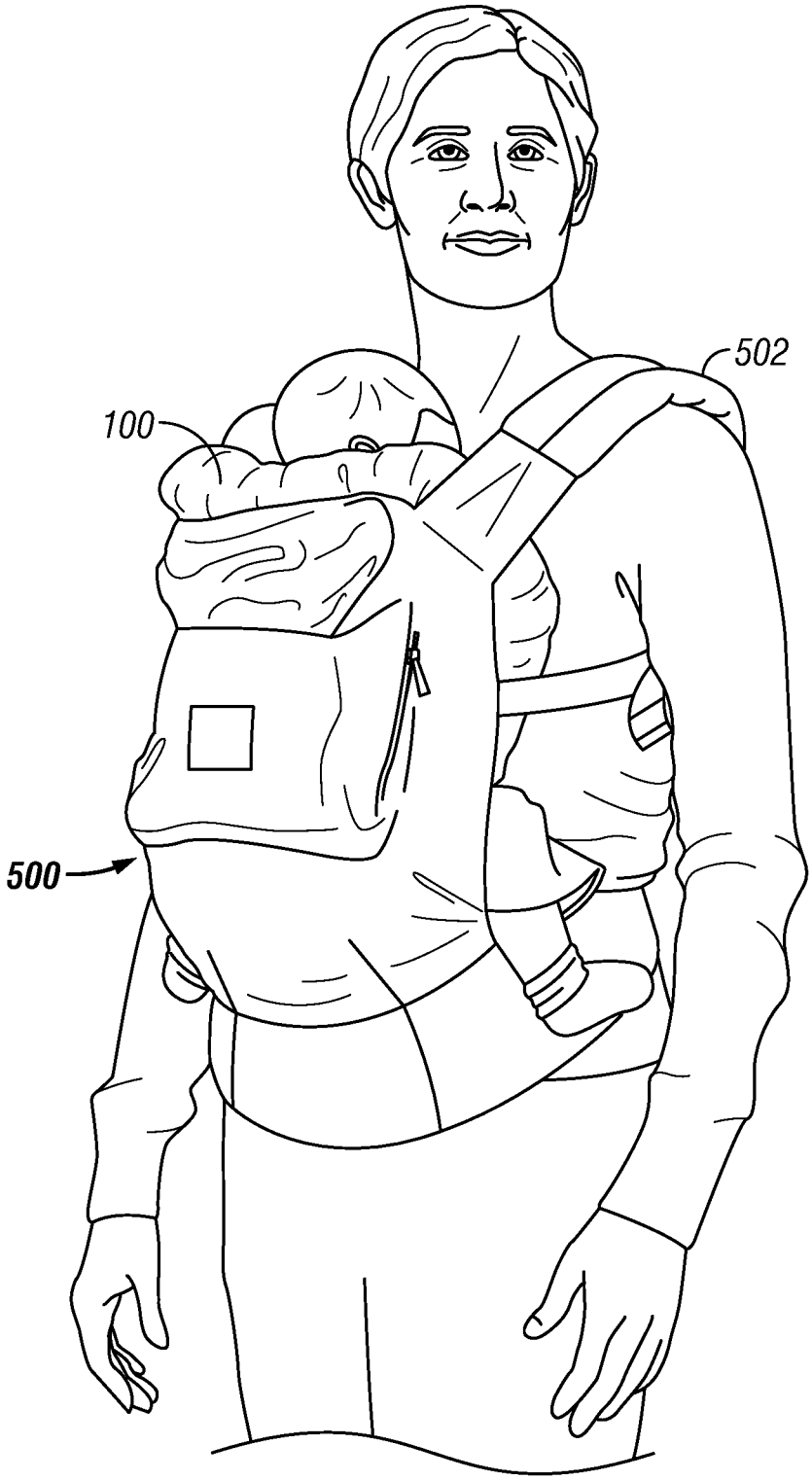
FIG. 9 is a diagrammatic representation of an adult wearing an embodiment of a child carrier in a front position with and embodiment of an infant insert in place.
Figure 10:
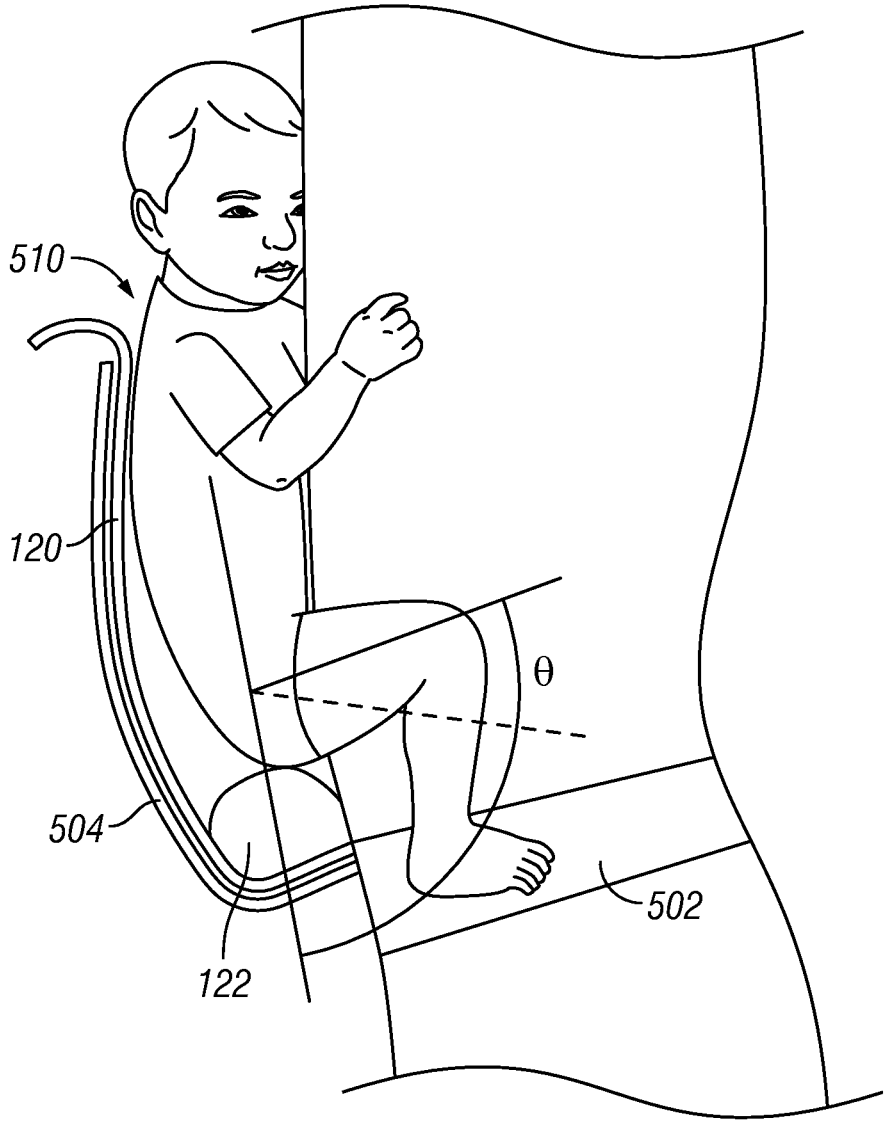
FIG. 10 is a diagrammatic representation illustrating an infant in position in an embodiment of an infant insert when used in conjunction with a child carrier.

With a newborn or younger infant, the feet can come together so that the infant is sitting in a position similar to a lotus position. However, as the infant grows older, the legs will naturally open. As this happens, the parent can position the legs in a spread position around the wearer. FIG. 9 is a diagrammatic representation of an infant in infant insert 100 in a child carrier 500 with the infant having its legs at the side of the parent. FIG. 10 is a diagrammatic representation of a cutaway view illustrating an infant in position in infant insert 100 when used in conjunction with carrier 500. FIG. 10 illustrates a flexible panel 504 and a portion of harnessing 502. Panel 504 forms a pouch or sling in which a child typically sits (denoted by area 510). Infant insert 100 is positioned in this area and may be long enough to extend out of this area. The infant can be positioned similarly to that described in conjunction with FIG. 8 but with the infant's legs spread to the sides of the parent. An angle Θ of the infant's femur to the coronal plane can be maintained. Additionally, the knees can be spread apart to desired distance. If the infant's legs extend out of the front opening of the infant insert, the rail 112 (shown in FIG. 1) can provide additional padding for the infant's legs.

When the infant has its knees elevated at the same level as the bellybutton, and the legs are naturally spread (typically with each knee having an angle of about 45-60 degrees from the median plane), the infant is in a "spread-squat-position." The spread-squat-position correctly positions the femur in the hip joint, or acetabulum, so that all areas of the acetabulum are strained equally. It is believed that this aids in development of the core of the bone. As can be seen in FIGS. 8 and 10, embodiments described herein can allow an infant to be positioned in a spread-squat-position in a child carrier.

Embodiments of infant inserts described herein provide several advantages. Compared to previous inserts in which the infant reclined in a sling like position, embodiments described herein allow an infant to be positioned front-to-front with its parent. This can be a more convenient position for the parent and foster closeness. The infant is in a relative upright position with the insert supporting infant's spine, neck and legs. The infant's weight is distributed across the infant's bottom, thighs and back so that the sacrum does not bear too much weight and the infant can rest with a more naturally curved spine in a spread-squat-position that is believed to be better for pelvic and spinal development.

While embodiments described above have been described in terms of a removable infant insert that is placed in an existing carrier, an infant insert, in other embodiments, may be a non-removable component of the child carrier. In other embodiments, the infant insert may be attached to the child carrier with buttons, hook and eye fasteners, clasps or other mechanism. Inserts can be sized as desired. According to one embodiment, an infant insert can be sized to accommodate up to an average six month old child.

In the foregoing specification, the disclosure has been described with reference to specific embodiments. However, as one skilled in the art can appreciate, embodiments of the inserts disclosed herein can be modified or otherwise implemented in many ways without departing from the spirit and scope of the disclosure. Accordingly, this description is to be construed as illustrative only and is for the purpose of teaching those skilled in the art the manner of making and using embodiments of a carrier. It is to be understood that the forms of the disclosure herein shown and described are to be taken as exemplary embodiments. Equivalent elements or materials may be substituted for those illustrated and described herein. Moreover, certain features of the disclosure may be utilized independently of the use of other features, all as would be apparent to one skilled in the art after having the benefit of this description of the disclosure.

What is claimed is:

1. An infant insert to carry an infant comprising:

a flexible panel having an inner surface and an outer surface, the flexible panel having a curved shape that narrows toward the bottom of the flexible panel, the flexible panel defining a front opening to an area for holding an infant without use of a crotch strap, the flexible panel sized to provide support along the infant's spine and neck, and wherein a first side bottom corner and a second side bottom corner are joined together to form a cushion opening at the bottom of the flexible panel; and a cushion positioned in the cushion opening, the cushion shaped to support the infant forward of the infant's tailbone when in use;

wherein the infant insert is sized and configured for placement in a child carrying area of a front wearable child carrier to accommodate the infant in a wearer facing position with the infant's legs extending out the front opening and the infant's knees raised at least 90 degrees from the coronal plane.

2. The infant insert of claim 1, wherein the infant insert is adapted to support the infant in a position with the infant's femur at an angle of 90-120 degrees from the coronal plane.

3. The infant insert of claim 1, wherein the infant insert is adapted to support the infant in a position with the infant's knees at 45-60 degrees from the median plane.

4. The infant insert of claim 1, wherein the infant insert is adapted to promote a spread-squat-position.

5. The infant insert of claim 4, further comprising a cushion retaining strap coupled to the flexible panel and passing under the cushion.

6. The infant insert of claim 1, further comprising a closure strap having a first end coupled to the outer surface of the flexible panel on one side of a vertical access of the flexible panel and a second end coupled to the outer surface of the flexible panel on a second side of the vertical access of the flexible panel, the closure strap adapted to bring a first side edge and second side edge of the flexible panel closer together to close the front opening.

7. The infant insert of claim 1, wherein the infant insert comprises an area of spinal padding.

8. The infant insert of claim 7, wherein the area of spinal padding is progressively more padded toward the bottom of the area of spinal padding.

9. The infant insert of claim 1, wherein the flexible panel comprises a head rest area.

10. The infant insert of claim 1, wherein the flexible panel further comprises a rail of padding disposed at the edge of the panel, the rail adapted to support the infant's thighs and cushion around the head and neck.

11. An infant insert comprising:

an elongated flexible panel having an inner surface, an outer surface, a first side edge, a second side edge, a top edge, a bottom edge, a first bottom corner and a second bottom corner, wherein the first bottom corner and second bottom corner are stitched together to form a cushion opening at the bottom of the elongated flexible panel and cause the first side edge and second side edge to converge to form a tapered front opening to an area to hold an infant without use of a crotch strap, wherein the length of the elongated flexible panel from the top edge to the bottom edge is selected to allow the panel to provide support along the infant's spine and neck and provide a head rest area and the width of the elongated panel is selected so that the panel provides side padding for the infant when in use, the elongated flexible panel further comprising:

a continuous rail of padding along the first side edge, top edge and the second side edge;

an area of spinal padding disposed about a vertical axis of the elongated flexible panel to provide padding for the infant's spine;

a cushion disposed in the cushion opening at the bottom of the area to support the infant's pelvis;

wherein the infant insert is adapted to fit in a child carrying area of a front wearable child carrier to position the infant in a wearer facing position with the infant's legs extending out the front opening and the infant's knees raised at least 90 degrees from the coronal plane.

12. The infant insert of claim 11, wherein the cushion is positioned to support the infant in front of the infant's tailbone to prevent the sacrum from being in a weight bearing position.

13. The infant insert of claim 11, wherein the infant insert is adapted to support the infant in a spread-squat-position.

14. The infant insert of claim 11, further comprising a cushion retaining strap coupled to the elongated flexible panel and passing below the cushion to retain the cushion.

15. The infant insert of claim 11, further comprising a closure strap coupled to one side of the outer surface of the elongated flexible panel and to another side of the outer surface of the elongated flexible panel, the closure strap crossing the front opening.

16. The infant insert of claim 15, wherein the closure strap is adjustable.

17. The infant insert of claim 16, wherein the closure strap is detachably coupled to the elongated flexible panel on at least one end.

18. The infant insert of claim 11, wherein the area of spinal padding comprises a set of areas that are progressively more padded from the top of the set of areas to the bottom of the set of areas and wherein the lowest of the set of areas is positioned to support the infant's lower back.

19. The infant insert of claim 11, wherein the rail is positioned to pad the infant's legs if the infant's legs extend out the front opening to straddle the wearer.

20. A method of carrying an infant comprising:

providing an infant in an infant insert comprising:

a flexible panel having an inner surface and an outer surface, the panel having a curved shape that narrows toward the bottom of the panel, the panel defining a front opening to an area for holding the infant without use of a crotch strap, the flexible panel is sized to provide support along the infant's spine and neck; and a cushion disposed proximate to the bottom of the area for holding an infant, the cushion adapted to support the infant forward of the infant's tailbone when in use; positioning the infant insert in a child carrier area of a child carrier in a front carrying position on a wearer, wherein the infant insert is positioned so that the infant is facing the wearer of the child carrier and the infant's spine and neck are supported by the flexible panel; and tilting the infant's pelvis forward to encourage a natural curve in the infant's spine;

wherein the infant is positioned so that the infant's legs extend out the front opening and the infant's knees are raised at least 90 degrees from the coronal plane.

21. The method of claim 20, wherein the infant is positioned in a spread-squat-position.

22. The method of claim 20, further comprising decreasing the size of the front opening prior to inserting the infant insert into the child carrier.

* * * * *